US006474505B1

(12) United States Patent
Waters

(10) Patent No.: US 6,474,505 B1
(45) Date of Patent: Nov. 5, 2002

(54) MODULAR LIQUID CONTAINER AND DISPENSING SYSTEM

(75) Inventor: Robert Earl Waters, Inman, SC (US)

(73) Assignee: Spartanburg Stainless Products, Inc., Spartanburg, SC (US)

( * ) Notice: Subject to any disclaimer, the term of this patent is extended or adjusted under 35 U.S.C. 154(b) by 0 days.

(21) Appl. No.: 09/751,070

(22) Filed: Dec. 29, 2000

(51) Int. Cl.[7] ..... B67D 5/60; B67D 1/08

(52) U.S. Cl. ..... 222/66; 222/143; 222/151; 222/184; 222/185.1; 222/481.5

(58) Field of Search ..... 222/64, 66, 143, 222/148, 151, 184, 185.1, 481.5

(56) References Cited

U.S. PATENT DOCUMENTS

| | | | | |
|---|---|---|---|---|
| 3,186,577 A | | 6/1965 | Tennison | |
| 4,746,034 A | * | 5/1988 | Ata et al. | 222/143 |
| 5,156,298 A | * | 10/1992 | LaRue | 222/66 |
| 5,555,996 A | | 9/1996 | Lang-Ree et al. | |
| 5,579,912 A | | 12/1996 | Yamamoto | |
| 6,045,013 A | * | 4/2000 | Yang | 222/481.5 |
| 6,050,455 A | * | 4/2000 | Soehnlen et al. | 222/143 |
| 6,116,261 A | * | 9/2000 | Rosen | 222/148 |
| 6,135,324 A | * | 10/2000 | Schmitt | 222/143 |
| 6,293,430 B1 | * | 9/2001 | Haselden, Jr. | 222/148 |

FOREIGN PATENT DOCUMENTS

| | | | | |
|---|---|---|---|---|
| EP | 0 235 437 | * | 9/1987 | 222/66 |
| EP | 0 322 729 | * | 7/1989 | 222/64 |
| GB | 2 063 219 | * | 6/1981 | 222/481.5 |
| JP | 5-85 595 | * | 4/1993 | 222/66 |

* cited by examiner

*Primary Examiner*—Joseph A. Kaufman
(74) *Attorney, Agent, or Firm*—George W. Moxon, II; Brouse McDowell

(57) ABSTRACT

A modular container for storing and dispensing liquids which has a body, an upper protecting wall, a lower protecting wall, at least one connector port with a valve, preferably a second connector port attached to a tube that extends upwards into the interior of the body, and a level indicator. The first and second connector ports are attached to the bottom of the body and incorporate a connector and are connected through an opening in the lower protecting wall. The lower protecting walls of the container are such that they have the ability to nest within the upper protecting walls of additional containers, thus allowing two or more containers to be stacked one on top of another. The second connector port which is attached to the tube extending into the interior of the body can be used for the purpose of venting the interior of the body and for cleaning the inside of the container without the necessity of moving or transporting the container.

18 Claims, 6 Drawing Sheets

MODULAR LIQUID CONTAINER AND DISPENSING SYSTEM

BACKGROUND OF THE INVENTION

The present invention is related to containers for storing and dispensing liquids, such as beverages, which containers have the ability to nest one within another to be stackable and which incorporate a cleaning system allowing them to be cleaned-in-place.

To be useful, liquid containers and dispensing systems have been required to be small enough to be portable, while at the same time being large enough for sufficient capacity. Liquid containers and dispensers have commonly been of two distinct types the stainless steel pressurized container with a five-gallon capacity, and the disposable "bag-in-box" container of various capacities.

The stainless steel pressurized liquid container and dispenser has historically, or perhaps optimally, been limited to a five-gallon capacity, and is referred to by the accepted abbreviation "Figal." ("Figal" containers are generally described in U.S. Pat. No. 3,186,577 to Tennison.) Since "Figal" containers are pressurized, five gallons is the maximum amount of liquid that they can hold and still allow for portability.

A "Figal" container is usually constructed entirely of stainless steel, with exceptions sometimes for the top and bottom parts of the containers, which can be constructed of resilient materials if desired. (See, for example, U.S. Pat. No. 5,579,912 to Yamamoto.) Since "Figal" containers are pressurized, they must be returned to the factory to be cleaned and sanitized before they can be re-used. This creates an inconvenience and is very inefficient.

The "bag-in-box" liquid container and dispenser is less expensive than its "Figal" counterpart, but it is disposable and cannot be re-used. ("Bag-in-box" containers are generally described in U.S. Pat. No. 5,555,996 to Lang-Ree et al.) The system commonly consists of a plastic bag full of liquid placed inside a plastic crate. When the liquid is emptied from the plastic bag, it cannot be re-filled or re-used, and must be disposed of. This presents an annoying waste disposal problem.

Furthermore, the "bag-in-box" dispensing system can also be difficult to operate due to the fact that a spigot of some sort must be connected to the bag containing liquid. Since there is no pressurization involved in the "bag-in-box" system, the liquid capacities can be greater than 5 gallons. Larger capacities, however, will inhibit portability since the "bag-in-box" systems must be moved and replaced after the container is emptied.

Overall, the "Figal" and "bag-in-box" containers do not lend themselves to an efficient system of dispensing liquids. While both types of containers may have the ability to stack one upon another, the containers must be re-arranged every time one of the containers requires re-filling, cleaning, or disposing. There is no general system for controlling or monitoring the dispensing or levels of the liquids in the containers.

SUMMARY OF THE INVENTION

The present invention is a modular, stackable, and re-usable liquid container and dispensing system, which can be used in a variety of capacities, and which incorporates an interior cleaning system that allows the interior of the container to be cleaned-in-place, i.e. to have the interior of the container cleaned without moving or transporting the container. The present invention 1) does not require pressurization, 2) it is not required to be moved or transported in order to be cleaned, and 3) it is capable of holding greater capacities of liquid in certain applications than similar prior art containers. Furthermore, two or more containers of the present invention can be stacked one on top of another and connected together to create a system that allows for 1) the efficient dispensing of liquids, 2) for the accurate monitoring of the various liquid levels, and 3) for the central management of the liquid supply process.

The present invention provides for a container having 1) a body to store liquids, 2) an upper protecting wall extending upwards from the top of said body, 3) a lower protecting wall extending downward from said body, and 4) at least one connector port attached to the bottom of said body, surrounded by the lower protecting wall, for filling and emptying the container. Preferably, the container has at least two connector ports, one for filling and emptying the container, and another connector port, connected to a tube which extends into the interior of said body, to allow for the pressure to equalize when filling and emptying.

The lower protecting wall of the container in the present invention is capable of supporting the container in an upright orientation and of nesting within the upper protecting wall of another separate container also designed in accordance with the present invention. This allows for the containers in the present invention to be stacked one upon another to achieve the maximum use of storage space and to efficiently provide for the central monitoring and control of more than one container. The lower protecting wall of the container in the present invention has an opening for access to the connector ports.

When one connector port of the present invention is attached to a tube which extends upwards through the interior of the body of the container to the height just above the top of the fill line of the body, it can be used to equalize the pressure during filling and emptying as well as so that a cleaning liquid can be sent up through the tube, then up and around the interior of the body, thus rinsing and cleaning the interior of the body.

The present invention includes a system for dispensing liquids where a central control module, located apart from the containers, is connected to level sensors on the containers for the purpose of 1) measuring the liquid level inside the bodies of the containers of the present invention, 2) monitoring the flow of liquids from the containers, and 3) controlling the valves attached to the connector ports which controls the flow and discharge of liquids into and out of the containers.

Thus, two or more containers of the present invention can be stacked together and connected together to form a controlled system of liquid dispensing and of monitoring the liquid levels in the various containers. The central control module can be used to generate a signal to indicate the levels of the liquids and to indicate need for cleaning and/or re-filling of the containers.

DETAILED DESCRIPTION OF THE INVENTION

Figure 1:
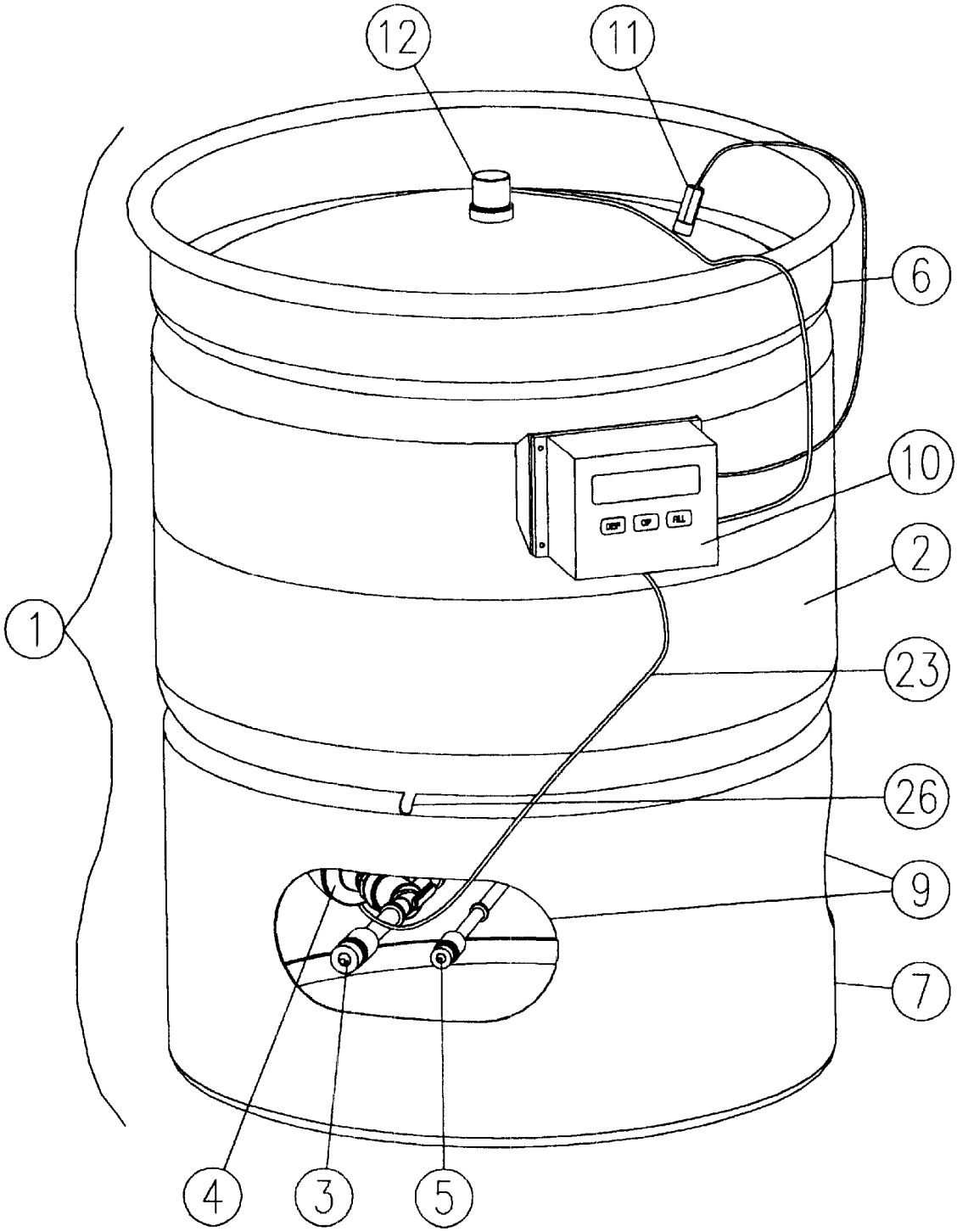
FIG. 1 shows a general view of a container of the present invention.

The present invention is a container and dispensing system for liquids which is designed to be modular, stackable, and re-usable. Two or more containers can be stacked one on top of another to maximize the use of space and to create a controlled system of the liquid dispensing. Furthermore, the containers can be allowed to remain in place where they can be cleaned and/or re-filled for re-use.

Each container is generally constructed with a body that contains and stores a liquid, an upper protecting wall, and a lower protecting wall. The body of the container is generally cylindrical and has a top and bottom, both of which extend in a concave shape to provide a continuous enclosure for liquids. While a cylindrical shape is preferable, the shape is not critical and the body and container may be formed into a variety of geometries and/or shapes as appropriate. The body can be made by conventional manufacturing techniques, such as molding, forging, casting and the like. Also, it can be made in parts and then assembled by, e.g., welding. The upper and lower protecting walls are generally cylindrical but the shape is not critical. Thus, they may be in any other shape or geometry. What is important is that the upper and lower protecting walls are able to nest together with a lower protecting wall fitting into an upper protecting wall. Further, the body is rigid or semi-rigid so that it is capable of supporting another container or containers when they are stacked on it, as well as containing the liquids stored in them.

The body of each container is filled or emptied with liquid through a connector port that is attached to the bottom of the body. The present invention preferably has two connector ports attached to the bottom of the body, one for the filling and emptying of liquids, and the other for the venting and/or cleaning the body of the container. The connector port that is used for the filling or emptying of liquids from the body of the container desirably will include a connector means of some kind for a hose. This connector means is preferably of a quick-connect design, but other connector means such as a manual clamp or a screw-type may be used as appropriate. What is important is that the connector means facilitates the connecting of a hose for the purpose of moving liquid into or out of the container.

The body of each container will be, preferably, vented in order to equalize the pressure on the outside of the container and the interior of the body. The vent need not be located at the bottom of the body, although it is preferred. Preferably, the vent is a tube, connected to a connector port attached to the bottom of the body, extending upwards through the body of the container, so that the opening at the distal end will be above the highest level of the liquid when the container is filled. The materials of construction of the tube, as well as its shape and/or size are not critical. It should be compatible with the liquids it contacts and can be made of stainless steel, plastic or the like. If it is rigid or semi-rigid, it does not need to be held in place. Flexible tubing would need additional support or brackets. This tube allows trapped air to escape, thus equalizing the pressure on the inside of the body with the outside of the body when the container is filled. When the process is reversed, the tube will also let air into the container when it is emptied. This tube can also be used for introducing a cleaning liquid, by, for example, spraying, to clean the interior of the body of the container. The connector port that is attached to the tube may include a connector means similar to the connector used to fill and empty the container so that a hose can be connected and a cleaning fluid can be sent up the tube and then sprayed up and around the interior of the body.

The process of cleaning and re-filling of the containers is performed without moving or returning the container to the factory. A hose with cleaning liquid is simply connected to the venting connector port of the container where it sits. The cleaning liquid may be extracted from the container through the filling and emptying connector port. The container is then re-filled with the appropriate liquid for storage and dispensing. The cleaning liquid can be allowed to soak in the body before it is emptied, and the cleaning step can be repeated more than once. As a final step in the cleaning process, a gas, e.g., $CO_2$, purge could be fed through the venting connector port, to purge any remaining cleaning liquid that remains. Also, it may be desirable to leave a gas blanket on the surface of the liquid used to fill the container when the container is refilled.

Each container also may include an exterior control box that is connected to 1) a level indicator for the liquids stored within the body, 2) a high level sensor which will prohibit liquids to reach a height above the tube, and 3) a valve means located at the connector port to control the filling and discharging of liquids. The control boxes of several containers of the present invention can be connected together to a central control module to 1) facilitate the central control of the dispensing of the liquids from the various containers, 2) to monitor the liquid levels in the various containers, 3) to control the filling and emptying of the liquids from the various containers, and 4) to signal the need for cleaning and/or re-filling of the containers. As can be appreciated, the control of the filling and emptying of the containers can be done via the exterior control box on the individual containers, via the central control box, or by linking the control boxes together. Thus, each control box may have settings for filling, emptying, and cleaning the container, depending upon how it is used. The central control box may also be used to generate a signal that the containers are empty, that the containers need to be refilled, that the containers need to be cleaned, or where there are backup containers with the same liquid, that the supply needs to be switched from an empty to a full container.

The materials of construction are not critical, although 304 or 316 stainless steel are preferred when the containers are used for beverages. The middle body can be made from a composite material where the inner surface is a composition compatible with the liquid it contains, while the outer surface is a composition which provides structural integrity for the structure. Further, the upper protecting wall and the lower protecting wall can be composed of materials different from the body, where they provide the strength necessary to support the container. The upper protecting wall and the lower protecting wall can be composed of materials from the group consisting of stainless steel, plastic, rubber, or other materials. The fact that the container is not under pressure and does not need pressure to empty or fill the container means that it can be constructed of lighter materials. This means that the container is lighter and more portable and can contain a larger volume per container weight than containers that must be pressurized.

The container 1 of the present invention for storing and dispensing liquids is shown in FIG. 1 in a general view, and is composed of three parts including 1) the body 2 to store liquids; 2) the lower protecting wall 7 which extends from the bottom of body 2 providing support for the container and providing protection for a first connector port 3 and a second connector port 5; 3) and the upper protecting wall 6 which extends from the top of body 2 providing protection for the components that extend from the top of body 2, and is compatible with the lower protecting wall 7 of other containers for the purpose of stacking the containers together.

Figure 5:
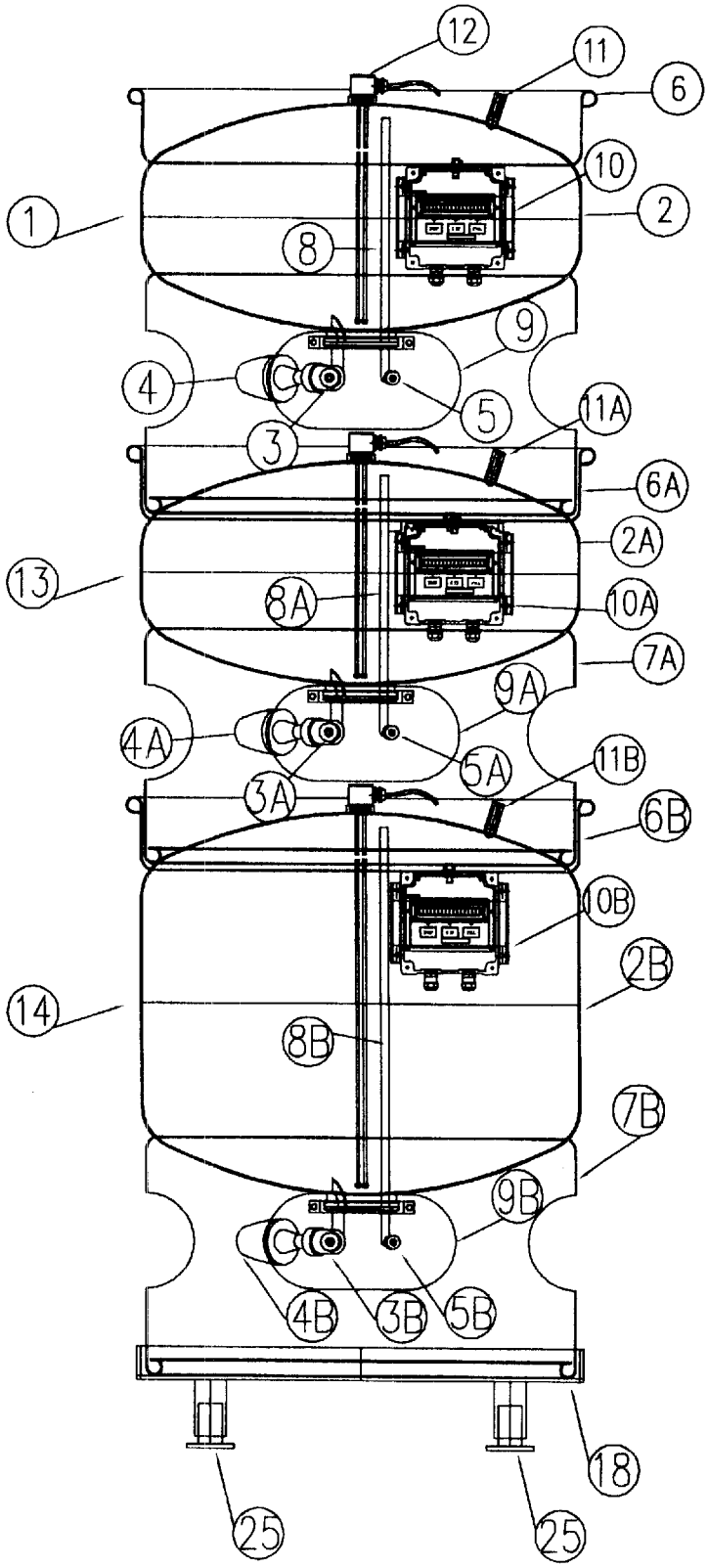
FIG. 5 shows a side view, partially in sectional view, showing three containers of the present invention in their stacked position.
Figure 6:
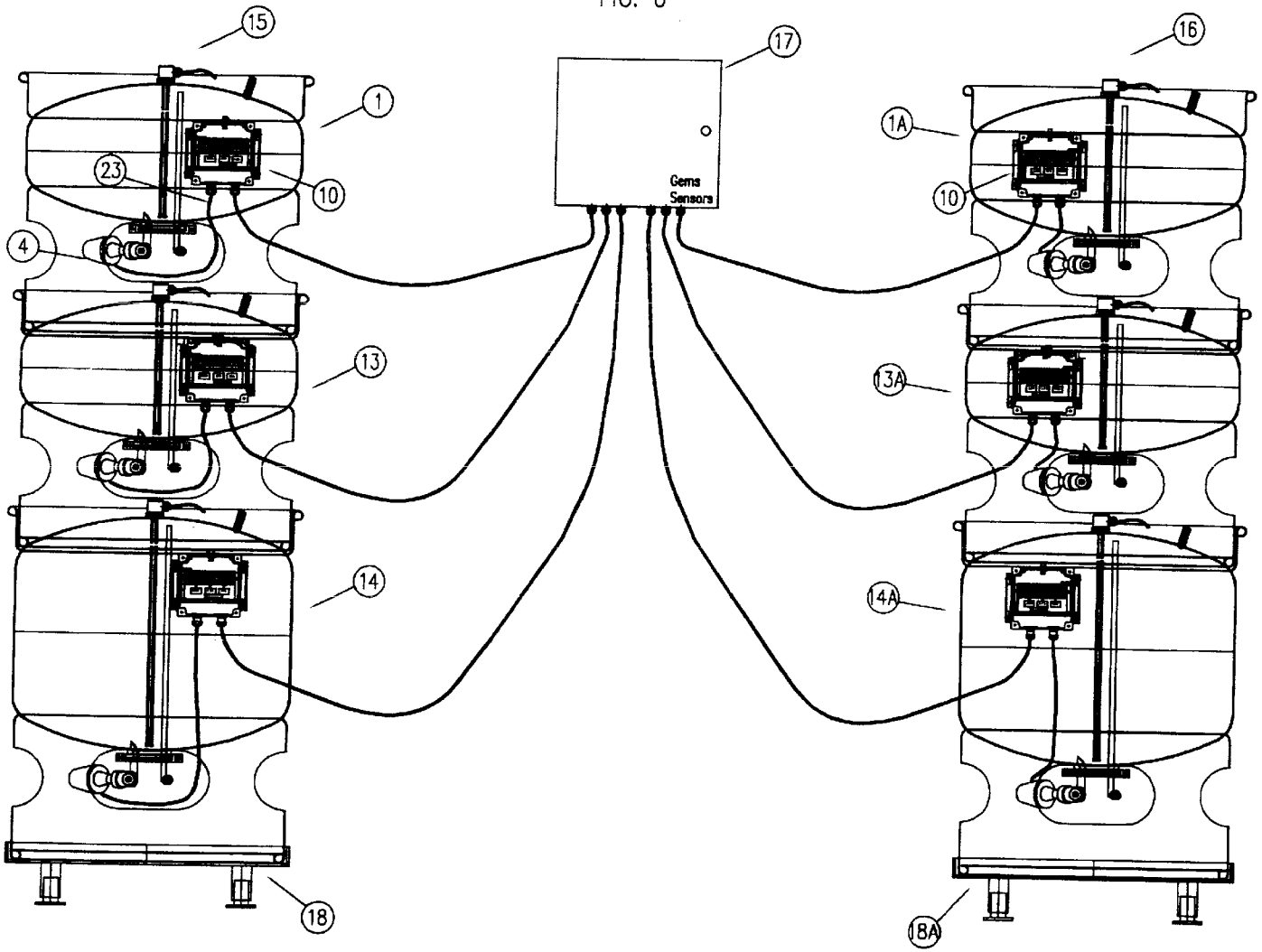
FIG. 6 shows a side view, partially in sectional view, showing multiple containers of the present invention stacked and connected together by means of a central control device.

The shape of the container 1 as shown in FIG. 1 is preferably cylindrical because of the ease of use, but the shape of the container 1 is not limited to a cylinder. The body 2 is generally cylindrical, having top and bottom walls extending in a concave shape to provide a continuous enclosure for liquids and can be formed to hold various capacities of liquid as shown in FIGS. 5 and 6, containers 1, 13, and 14.

The upper protecting wall 6 as shown in FIG. 1 extends upwards from the top of the body 2 and serves to support the lower protecting wall 7 of another container when such a lower protecting wall 7 is nested within the upper protecting wall 6. The upper protecting wall 6 also serves to provide protection for the components that extend from the top of the body 2. The shape of the upper protecting wall 6 is in a shape consistent with the body 2. The upper protecting wall 6 and the entire container 1 shown in FIG. 1 is in a cylindrical shape, which is preferable, but the shape of the body 2 and the upper protecting wall 6 is not limited to a cylinders.

The lower protecting wall 7 as shown in FIG. 1 extends downward from the bottom of the body 2 and provides support and protection for a first connector port 3 and a second connector port 5. The lower protecting wall 7 has an opening 9 to allow access to a first connector port 3 for filling and emptying the container, and a second connector port 5 which functions to vent and clean the interior of the body. When used as a vent, it may be desirable to attach a filler (not shown) to prevent dust and miscellaneous solids from entering the body when discharging and to catch liquid drops when filling the body. Second connector port 5 can be connected to a hose for the purpose of cleaning the interior of the body, as can port 3, for the purpose of dispensing or filling of liquids into the body 2 of the container 1. The shape of the lower protecting wall 7 is in a shape consistent with the body 2. The lower protecting wall 7 and the entire container 1 shown in FIG. 1 is in a cylindrical shape, which is preferable, but the shape of the body 2 and the lower protecting wall 7 is not limited to a cylinder.

Figure 4:
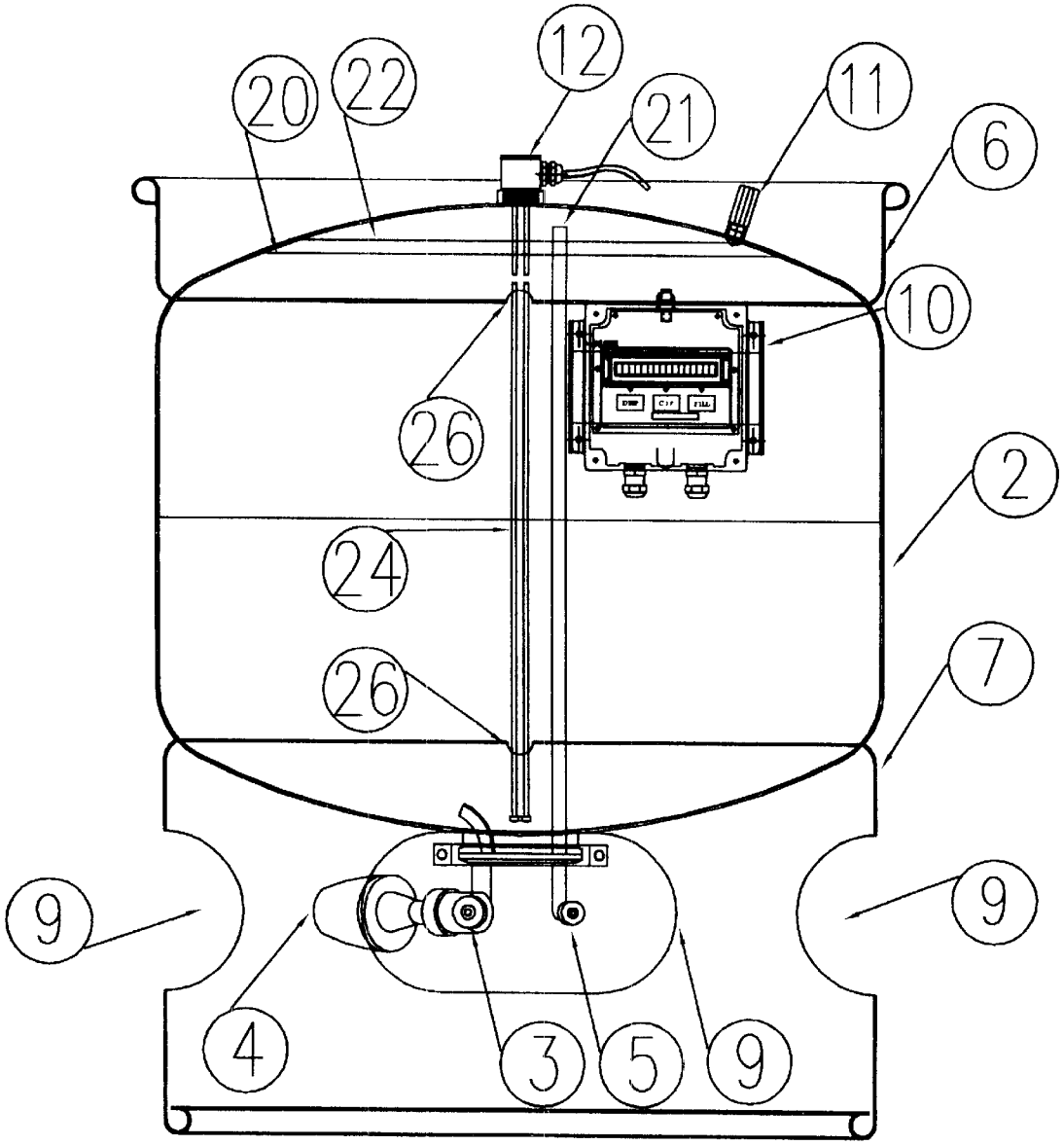
FIG. 4 shows a side view, partially in sectional view, showing the container of the present invention.

The upper lip of the upper protecting wall 6 is rolled outward as shown in FIG. 4 in order to strengthen the rim of the upper protecting wall. The lower lip of the lower protecting wall 7 is similarly strengthened by rolling inward. The rolled lips of the upper protecting wall and the lower protecting wall also serve to avoid sharp edges on the upper protecting wall 6 and the lower protecting wall 7. Also, it may be desirable to provide openings 9 on other sides of the lower protective wall to provide access to the underside of body 2 as well as the port connections. Further, when the exterior of the containers will need to be kept clean, such as by washing or hosing the exterior of the container, it may be desirable to provide drains 26, such as the semicircular openings shown, or other shapes, since the shape is not critical, to drain, e.g., the wash water that would otherwise collect between the body 2 and the upper protective wall 6.

Figure 3:
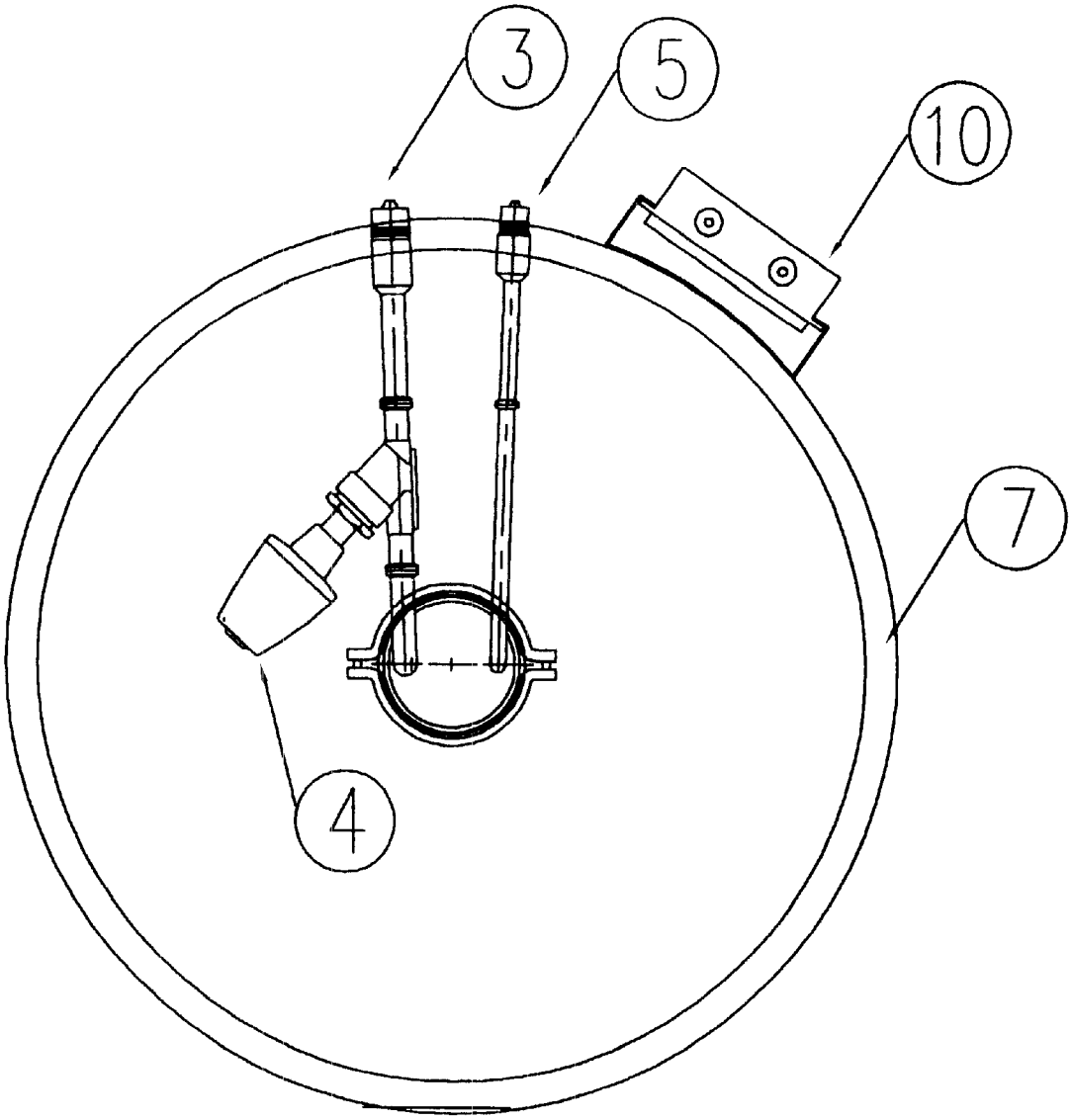
FIG. 3 shows a bottom view of the present invention.

Attached to the bottom of the body 2, there is a first connector port 3 and a second connector port 5 as shown in FIG. 3. The first connector port 3 has at one end a connector means enabling a hose to be connected to it. A quick-connect connector means is preferable if the container is being used for beverages or other similar liquids, but other connector means can be used as appropriate. The connector means is exposed through the opening 9 in the lower protecting wall 7. The first connector port 3 extends upwards into the body 2 as shown in FIG. 4 of the present invention so far as necessary to allow liquids to flow into and out of said body 2. There is a valve means 4 attached to the first connector port 3 as shown in FIG. 3 for the purpose of controlling the discharge of liquids through the first connector port 3. The valve is not critical and is chosen for what is appropriate for the liquid being controlled. Examples, without intending to be limited, are globe valves, gate valves, and the like as are known in the art. The valve means 4 is attached to a control box 10 by means of a hose as shown in FIG. 3. The control box 10 is capable of controlling the flow of liquid into or out of the first connector port 3.

The second connector port 5 has at one end a connector means enabling a hose to be connected to it as shown in FIG. 3. This connection is exposed through the opening 9 in the lower protecting wall 7. The second connector port 5 is connected to a tube 8 which extends upwards into the interior of the body 2 to just below the top of the body 2 as shown in FIG. 4. For example, the normal liquid level 20, shown as a dotted line, is well below the distal end 21 of pipe 8. High level sensor 11 is placed at a level 22, shown as another dotted line, so the level remains below the distal end 21 of tube 8.

The tube 8 is intended to be kept above the level of the liquid inside the body in order to allow air trapped inside the body to escape through the tube 8 and the second connector port 5. This means of venting the interior of the body 2 allows the pressure on the outside of the container 1 and the inside of the body 2 to be equalized and prevents the creation of a vacuum. The means of venting could be accomplished by another similar construction involving a tube, but it is preferable that the means of venting is accomplished with the tube 8 connected to a second connector port 5, so that the tube 8 can also be used to spray cleaning fluid up and around the interior of the body 2.

The tube 8 can be used to spray a cleaning fluid up and around the interior of the body 2 and such cleaning fluid can be discharged through a first connector port 3. If desired, the cleaning fluid could be allowed to soak or bathe the interior of the body 2 to clean the interior of the body 2 more thoroughly. After the cleaning process, the cleaning fluid can be discharged through the first connector port 3 and a purging gas or liquid could be sprayed through the tube 8 to purge the remaining cleaning fluid from the interior of the body 2.

The control box 10 is located on the exterior of the container 1 as shown in FIG. 1. The control box 10 is connected by a connector means 23 to the valve 4 attached to a first connector 3 for the purpose of controlling the discharge of liquid through the first connector port 3. The control box 10 is also connected to the continuous level sensor 12 and the high level sensor 11 for the purpose of monitoring the liquid level in the interior of the body 2.

Figure 2:
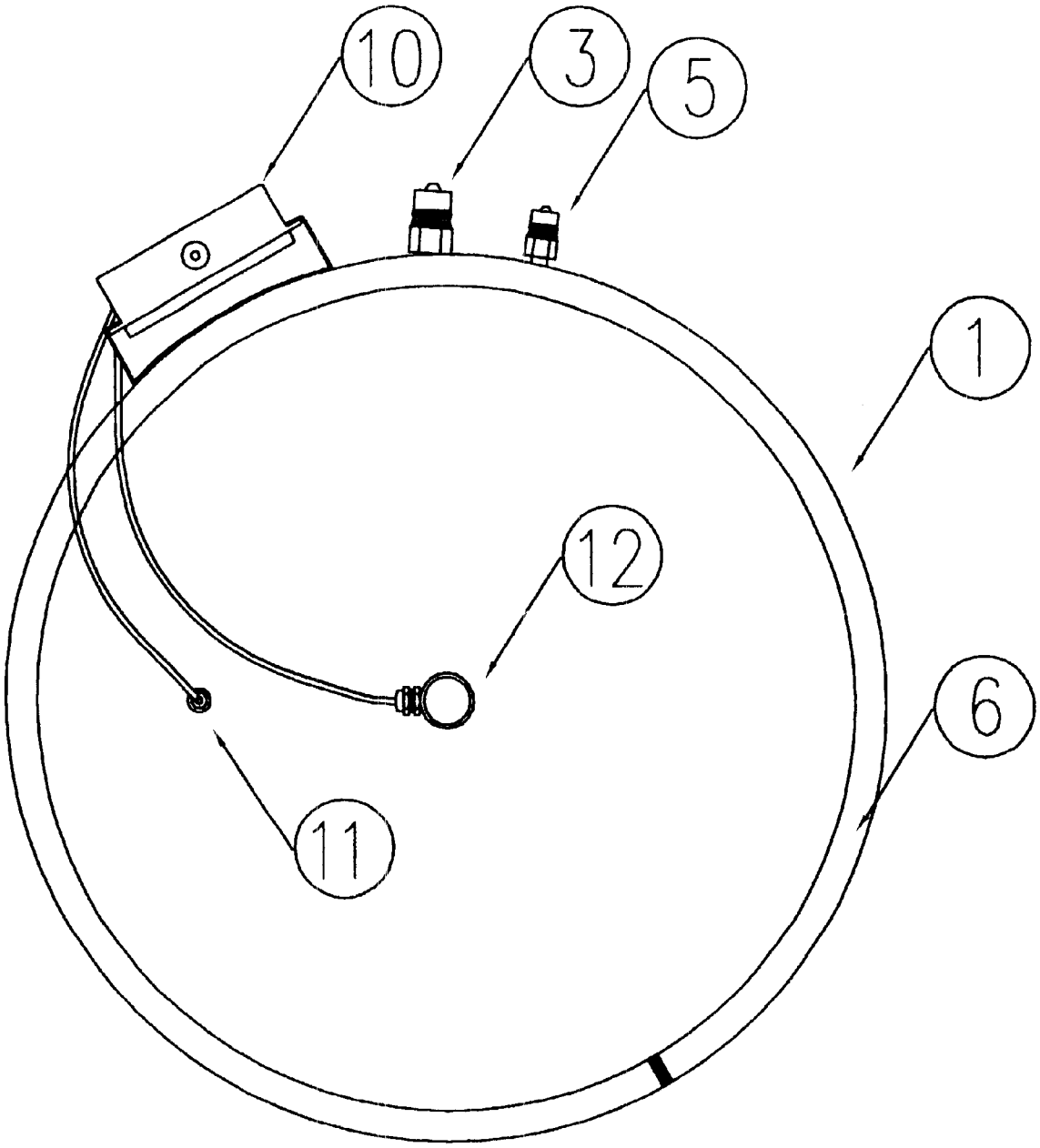
FIG. 2 shows a top view of the present invention.

FIG. 2 shows the continuous level sensor 12, having a probe 24 which extends the length of the body 2, and is located on the top of the body 2, surrounded by the upper protecting wall 6, and connected to the control box 10. The high level sensor 11 is located on the top of the body 2, surrounded by the upper protecting wall 6, and positioned closer to one side of the top of the body 2, away from the center of the top of the body 2, and connected to the control box 10.

The stackability of the containers in the present invention is illustrated in FIG. 5 where container 1 is stacked on top of container 13, which in turn is stacked on top of container 14. The lower protecting wall 7 of container 1 is such that it nests within the upper protecting wall 6A of container 13. In turn, the lower protective wall 7A of container 13 nests within the upper protective wall 6B of container 14. The stacking of containers 1, 13 and 14 does not prohibit access to the openings 9, 9A or 9B of the lower protecting walls 7, 7A and 7B of containers 1, 13 or 14 and thus the first connector ports 3, 3A, and 3B and the second connector ports 5, 5A, and 5B are accessible for the purpose of connecting hoses.

FIG. 5 illustrates that containers 1 and 13 are smaller than container 14. So, two or more containers of the present invention with differing capacities may be used as needed and required. They all need not be the same size.

It may be desirable to raise the stack of containers 13 and 14 off of the ground using a bottom support stand 18 having 3 or 4 vertical legs. This bottom support stand 18 facilitates the cleaning under the stack of containers and also provides for a means to level the stack of containers by having adjustable legs 25.

One or more stacks of containers 1 in the present invention can be connected together as shown in FIG. 6 to create a dispensing system. Stack 15 and stack 16 are stacks of containers 1, 13 and 14 of the present invention. Valve means 4 of container 1 in stack 15 is connected to a control box 10 by a connector 23. Similarly, each valve means of each container in stack 16 is connected to its control box. Each continuous level sensor 12 and each high level sensor 11 of each container in stack 15 and stack 16 is connected by a connector means to each control box 10 for the purpose of transmitting signals on the level of liquids in each container in stack 15 and stack 16. In turn, the control box 10 of each container in stack 15 and stack 16 is connected by electrical means to the central control module 17 as shown in FIG. 6 for the purpose of monitoring and controlling the functions of the valve means 4 on the containers 1 in stacks 15 and 16. Through this central control module 17, it is possible to monitor the levels of all containers 1 in stacks 15 and 16, while allowing for the control of the dispensing of all the containers 1 in stacks 15 and 16. The invention is not limited to controlling the stacks through the individual control boxes and could be configured to go directly from the containers without using the individual control boxes.

Stack 15 and stack 16 are created of containers 1 with varying body 2 capacities, as also illustrated in FIG. 5. The fact that containers 1 with varying capacities may be used, can create a more efficient system of liquid dispensing. For example, if a greater amount of a particular beverage is required, that beverage may be stored in a container 1 with a larger capacity body 2. Other beverages that are not in such high demand may be stored in a container 1 with a smaller capacity body 2. The central control module 17 can be used to monitor the levels of liquid in the various containers 1 and can be used to switch the discharge of liquid from a container in stack 15 that may have a low liquid level, to another container in stack 16 that contains the same liquid. This example is simply one embodiment of the present invention and is not meant to limit the present invention.

The foregoing embodiments of the present invention have been presented for the purposes of illustration and description. These descriptions and embodiments are not intended to be exhaustive or to limit the invention to the precise form disclosed, and obviously many modifications and variations are possible in light of the above disclosure. The embodiments were chosen and described in order to best explain the principle of the invention and its practical applications to thereby enable others skilled in the art to best utilize the invention in its various embodiments and with various modifications as are suited to the particular use contemplated. It is intended that the invention be defined by the following claims.

What we claim is:

1. A container for storing and dispensing liquids comprising a body for containing liquids having a top and bottom;

an upper protecting wall, extending upwards from top of said body;

a lower protecting wall, extending downwards from bottom of said body;

at least one connector port, attached to bottom of said body, surrounded by said lower protecting wall, for the purpose of filling and emptying said body with liquids;

a means connected to said at least one connector port for controlling the flow of liquids through the said at least one connector port; and a second connector port attached to the bottom of said container includes a tube which is attached to said connector port and said tube extends into the interior of said body and the distal end of said tube is open and above the fill level of the liquid inside the interior of said body to provide venting means.

2. The container of claim 1 wherein said venting means is for the purpose of equalizing the pressure on the interior of the body of the container with that of the exterior of the container.

3. The container of claim 1 wherein a first connector port is used for the purpose of filling or emptying said body with liquids.

4. The container of claim 1 wherein said second connector port is for the purpose of cleaning the interior of said body with cleaning liquid.

5. The container of claim 4 wherein said tube has the purpose of spraying or filling the interior of the body with cleaning liquid.

6. The container of claim 1 wherein said lower protecting wall has an opening for permitting access to said at least one connector port.

7. The container of claim 1 wherein body of container is composed of stainless steel.

8. The container of claim 1 wherein said upper protecting wall and said lower protecting wall are composed of material selected from the group consisting of stainless steel, plastic, rubber, and composite materials.

9. The container of claim 1 further including a level sensor which measures the level of any liquid contained in said body.

10. The container of claim 1 further including a high level sensor that signals a predetermined high level of any liquid contained in said body.

11. The container of claim 1 wherein the means for controlling the flow of liquid through said at least one connector port is a valve means.

12. The container of claim 1 wherein the means for controlling the flow of liquid through said at least one connector port is a valve means which is pneumatically controlled.

13. The container of claim 1 wherein the upper protective wall of the container can be the lower protective wall of another container whereby the container can be stacked in nesting relationship on another container or can receive another container in stacking and nesting relationship.

14. A system of containing and dispensing liquids comprising at least two modular liquid containers each comprising a body for containing liquids having a top and bottom;

an upper protecting wall, extending upwards from top of said body;

a lower protecting wall, extending downwards from bottom of said body;

at least one connector port, attached to bottom of said body, surrounded by said lower protecting wall, for the purpose of filling and emptying said body with liquids; and a means connected to said at least one connector port for controlling the flow of liquids through the said at least one connector port;

wherein the lower protecting walls of a modular liquid container can be nested within the upper protecting walls of another modular liquid container, allowing at least two containers to be stacked one on top of another;

venting means which extends upwards into the interior of the body of said modular liquid containers for the purpose of allowing the pressure in the interior of said body to equalize during the filling and emptying, and to allow cleaning fluids to be dispersed into and around the interior of the said body;

a level sensor to measure the level of the liquid inside the body of containers;

wherein a hose is attached to each of said at least one connector port for the purpose of discharging liquid from or filling the body of said modular liquid containers; and central control means, for controlling the filling, emptying, and cleaning of said liquid containers, connected to each modular liquid container.

15. A system of containing and dispensing liquids according to claim 14 wherein the venting means is a tube in the interior of said body for the purpose of equalizing the pressure on the outside of said modular liquid container and the interior of said body and the distal end of the tube is located just above the highest liquid level.

16. A system of containing and dispensing liquids according to claim 14 wherein each said modular liquid container incorporates a control box, located on the exterior of said modular liquid containers, and which is connected to said level sensor, said high level sensor, and said valve means.

17. A system of containing and dispensing liquids according to claim 14 wherein said control boxes of said modular liquid containers are interconnected with a central control module to enable central control of several said control boxes.

18. A system according to claim 14, wherein there are at least two stacks of containers, each stack containing the same liquids so that when a container empties, said central control means will close the control means on a container in a first stack of containers and open the control means on a container having the same liquid in a second stack.

* * * * *